US007891139B2

(12) United States Patent
Nagakura

(10) Patent No.: US 7,891,139 B2
(45) Date of Patent: Feb. 22, 2011

(54) DOOR DRIVING CONTROL METHOD

(75) Inventor: Takayuki Nagakura, Nagano (JP)

(73) Assignee: Fuji Electric Systems Co., Ltd., Tokyo (JP)

( * ) Notice: Subject to any disclaimer, the term of this patent is extended or adjusted under 35 U.S.C. 154(b) by 486 days.

(21) Appl. No.: 11/682,461

(22) Filed: Mar. 6, 2007

(65) Prior Publication Data

US 2009/0100758 A1 Apr. 23, 2009

(30) Foreign Application Priority Data

Mar. 28, 2006 (JP) ..... 2006-089006

(51) Int. Cl.
*E06B 3/00* (2006.01)

(52) U.S. Cl. ..... 49/506; 49/24; 49/360

(58) Field of Classification Search ..... 49/24, 49/360, 506

See application file for complete search history.

(56) References Cited

U.S. PATENT DOCUMENTS 3,456,387 A * 7/1969 Tolson ..... 49/31
3,561,160 A * 2/1971 Chan ..... 49/35
4,433,274 A * 2/1984 Duhame ..... 318/283
4,533,901 A * 8/1985 Lederle ..... 49/28
4,544,865 A * 10/1985 Sharp ..... 318/53
5,212,908 A * 5/1993 Norman ..... 49/18
5,226,256 A * 7/1993 Fries et al. ..... 49/13
5,782,036 A * 7/1998 Bertieri et al. ..... 49/25
5,983,567 A * 11/1999 Mitsuda ..... 49/26
7,064,505 B2 6/2006 Sato et al.
7,187,987 B2 * 3/2007 Andersen ..... 700/20
2005/0102903 A1 5/2005 Takahashi
2008/0236048 A1 * 10/2008 Kowalczyk et al. ..... 49/280

FOREIGN PATENT DOCUMENTS

JP 2005-145240 A 6/2005
JP 2005-349909 A 12/2005

* cited by examiner

*Primary Examiner*—Jerry Redman
(74) *Attorney, Agent, or Firm*—Rabin & Berdo, PC

(57) ABSTRACT

In controlling, with recognition of their installation positions, the opening/closing driving of plural doors that are driven by respective linear motors, each door is driven closed by switching the door opening/closing drive torque to high torque if the drive speed of the door has become less than or equal to a prescribed speed. In doing so, operation instruction computing sections set high torque application periods for respective doors so that the periods of high-torque closure driving of respective doors or predetermined door groups do not overlap with each other, and issue instructions to drive the doors closed with high torque only during the high torque application periods.

3 Claims, 9 Drawing Sheets t0
t1
t2
t3
t4
t5
t6
RESET
SET
H
L
0
TIME t
OUTPUT IN CLOSING DIRECTION t0
t1 t2
t3
t4
t6
t7
t8 t9
t10
TIME t
RESET
SET
H
L
0
OUTPUT IN CLOSING DIRECTION
OPENING OPERATION

DOOR DRIVING CONTROL METHOD

BACKGROUND OF THE INVENTION

1. Field of the Invention

The present invention relates to a door driving control apparatus for controlling, in a train or the like, the opening/closure driving of a vehicle door that is opened and closed by a motor.

2. Description of the Related Art

In automatic opening/closing doors for getting passengers on/off of trains, automobiles, etc., from the viewpoint of power saving, protection from burning of door driving motors, and prevention of erroneous operation during running, usually each door is driven by supplying electric power to a door driving motor only in opening or closing it and in other situations (the door is closed) the door is locked mechanically by means of a locking device such as a lock pin and no electric power is supplied to the door driving motor.

FIG. 6 shows the configuration of a conventional door driving control apparatus for a railway vehicle. The door driving control apparatus 10 is equipped with an operation instruction computing section 11, a power conversion section 12, and a communication interface 14 and is connected to a power source 21, a linear motor 2, a position detector 5 which are provided on a vehicle body 20 and a train control apparatus 22 provided in a motorman's cab.

Linear motor 2, a movable portion of which is connected to a link portion 3 provided on a door 1, opening/closure-drives the door 1. The door 1 is provided with a locking device 7 for fixing the door 1 mechanically. The position detector 5 detects a position and a speed of the movable portion of the linear motor 2 and outputs a thus-acquired door position detection value S1 to the operation instruction computing section 11.

Among three phase lines (having U, V, and W phases) which connect the power conversion section 12 to the linear motor 2, output current detectors 4 are connected to the U-phase and W-phase lines, respectively. Output current detection values S2 obtained by detecting a U-phase current and a W-phase current with the output current detectors 4 are input to the operation instruction computing section 11.

With the above configuration, when receiving a door operation instruction signal S3 from the train control apparatus 22, the operation instruction computing section 11 performs door speed feedback control using the door position detection value Si and the output current detection values S2. The power conversion section 12 converts the power from the power source 21 according to this control. The linear motor 2 is supplied with converted power and its driving is thereby controlled. The door 1 is opening/closure-driven as a result of this driving of the linear motor 2.

Door driving control apparatus 10 for controlling the opening and closing of the door 1 is provided for each door (e.g., each of first to eighth doors) as indicated by reference symbols 10-1 to 10-8 in FIG. 7 and is connected to the train control apparatus 22 via the communication interface 14.

As exemplified in FIG. 8, door installation positions are discriminated from each other by setting addresses A1-A8 for the respective door positions in each car and storing the addresses A1-A8 in the respective door driving control apparatus 10-1 to 10-8.

In automatic opening/closing doors for trains, automobiles, etc., when a high pressure is exerted on the door 1 by passengers in a fully jammed car, for example, and the friction of the door 1 is thereby made unduly high or a foreign object is pinched by the door 1, correct operation of the door 1 is secured by increasing the driving force for the door 1, opening and closing the door again (i.e., temporarily opening the door 1 being closed and starting a closing operation again after a lapse of a prescribed time with an assumption that a passenger, a bag, or the like has escaped or has been removed) after increasing the driving force for a prescribed time, or performing a like operation. However, when foreign objects are pinched by plural doors 1, the driving force is increased for all of those doors 1 and hence the total power consumption becomes large.

As shown in FIG. 9, usually the plural door driving control apparatus 10-1 to 10-8 of a car are connected to the power source 21 which is provided for the same vehicle body as the door driving control apparatus 10-1 to 10-8 are provided on, and other apparatus such as an air conditioner 31 and an inverter apparatus for fluorescent lamps are also connected to the power source 21. Therefore, if the total power consumption becomes large as a result of an increase in the door driving force for plural doors, the voltage of the power source 21 decreases, which may adversely affect the operation of other apparatus in the same car as exemplified by flickering of fluorescent lamps.

Exemplary countermeasures against the above problem are disclosed in JP-A-2005-145240 and JP-A-2005-73381. In JP-A-2005-145240, the fact that high torque is being output for one or some of the doors of the same power supply system is communicated between the door driving control apparatus 10-1 to 10-8 via the communication interfaces 14 over the inter-car network. Each door driving control apparatus outputs low torque while high torque is being output for another or other doors. In this manner, adjustments are made so that the power consumption of the entire car does not become unduly large.

In JP-A-2005-73381, each of the door driving control apparatus 10-1 to 10-8 restrict output torque in accordance with its input voltage or input current. In this manner, adjustments are made so that the power consumption of the entire car does not become unduly large.

However, the information that can be communicated over the inter-car network depends on the vehicle type. Therefore, information as to whether high torque is being output may not be available in certain vehicle types, in which case the technique of JP-A-2005-145240 cannot be utilized.

In the technique of JP-A-2005-73381, when an attempt is made to output high torque for all doors, the power supply voltage is lowered and the output torque is thereby restricted. This results in a problem that with restricted output torque the doors may not be operated or locked.

SUMMARY OF THE INVENTION

The present invention has been made to solve the above problems, and an object of the invention is therefore to provide a door driving control apparatus which makes it possible to output high torque for each door and thereby operate it and lock it reliably without reduction in power supply voltage even in the case where information as to whether high torque is being output cannot be communicated between door driving control apparatus.

To attain the above object, the invention provides a door driving control apparatus which drives a door closed by setting door opening/closing drive torque to ordinary torque or high torque when opening/closing driving of plural doors that are driven by respective motors is controlled, comprising setting means for setting a high torque application period for the door so that periods of high-torque closure driving of respective doors or predetermined door groups do not overlap with each other, and instructing means for issuing an instruction to drive the door closed with high torque only during the high torque application period thus set.

With this configuration, when high torque is necessary for plural doors, those doors can be driven open and closed with high torque in such a manner that the periods of high-torque driving of those doors do not overlap with each other even in the case where information as to whether high torque is being output cannot be communicated between the door driving control apparatus. Therefore, the power supply voltage does not decrease due to overlap between periods of high-torque driving and hence each door can be operated with high torque.

In the above door driving control apparatus, the instructing means may be such as to issue, at the end of the high torque application period, an instruction to perform a door re-opening and closing operation.

With this measure, a re-opening and closing operation is performed additionally at the end of a high torque application period in the control that prevents overlap between high-torque driving states of plural doors. Therefore, when foreign objects are pinched by plural doors, the plural doors can be closed with high torque without causing a decrease in power supply voltage and the foreign objects can be removed more properly.

In the above door driving control apparatus, the instructing means may be such as to issue an instruction to perform ordinary door closing driving without employing high torque if a door drive speed exceeds a predetermined speed in the high torque application period.

With this measure, an ordinary closing operation is performed if the door drive speed exceeds the predetermined speed in a high torque application period, that is, if a foreign object is removed during a closing operation of high torque. This dispenses with an unnecessary re-opening and closing operation and hence prevents useless power consumption.

As described above, the invention provides an advantage that high torque can be output for each door and each door can thereby be operated and locked reliably without reduction in power supply voltage even in the case where information as to whether high torque is being output cannot be communicated between door driving control apparatus.

DESCRIPTION OF THE PREFERRED EMBODIMENTS

Embodiments of the present invention will be hereinafter described with reference to the drawings.

First Embodiment

Figure 1A:
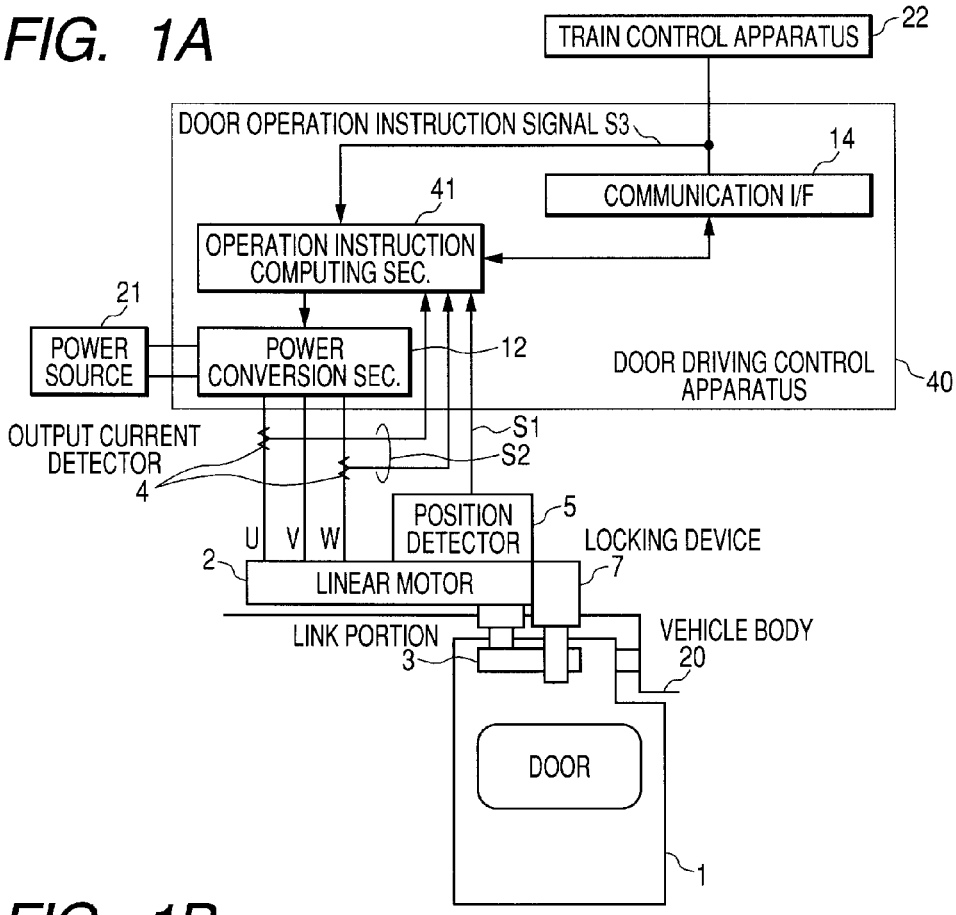
FIGS. 1A and 1B show the configuration of a door driving control apparatus for a railway vehicle according to a first embodiment of the present invention.
Figure 1B:
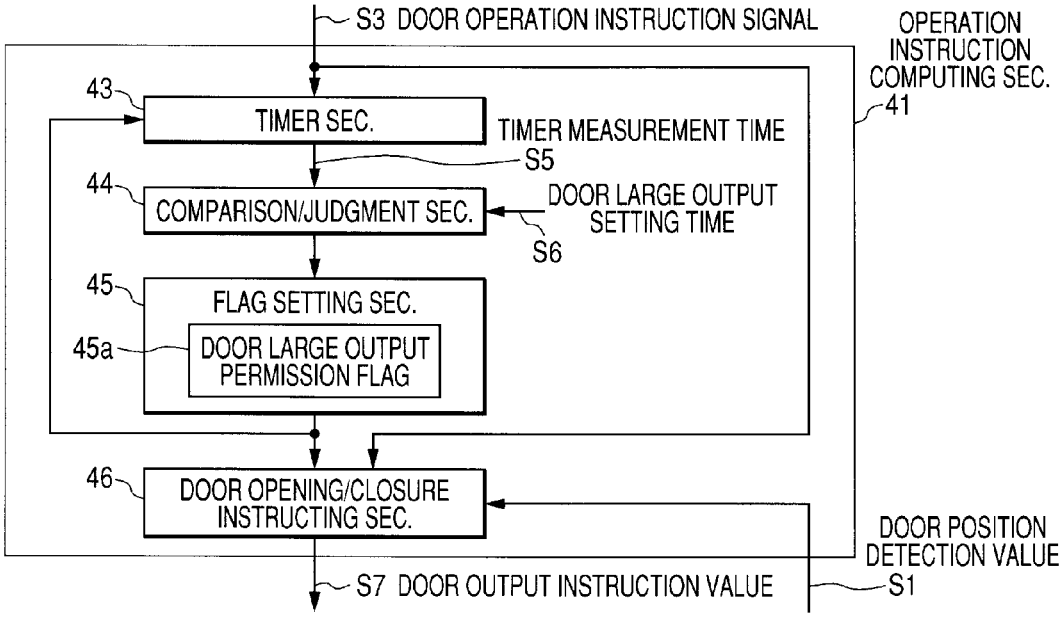

FIGS. 1A and 1B show the configuration of a door driving control apparatus for a railway vehicle according to a first embodiment of the invention.

Figure 6:
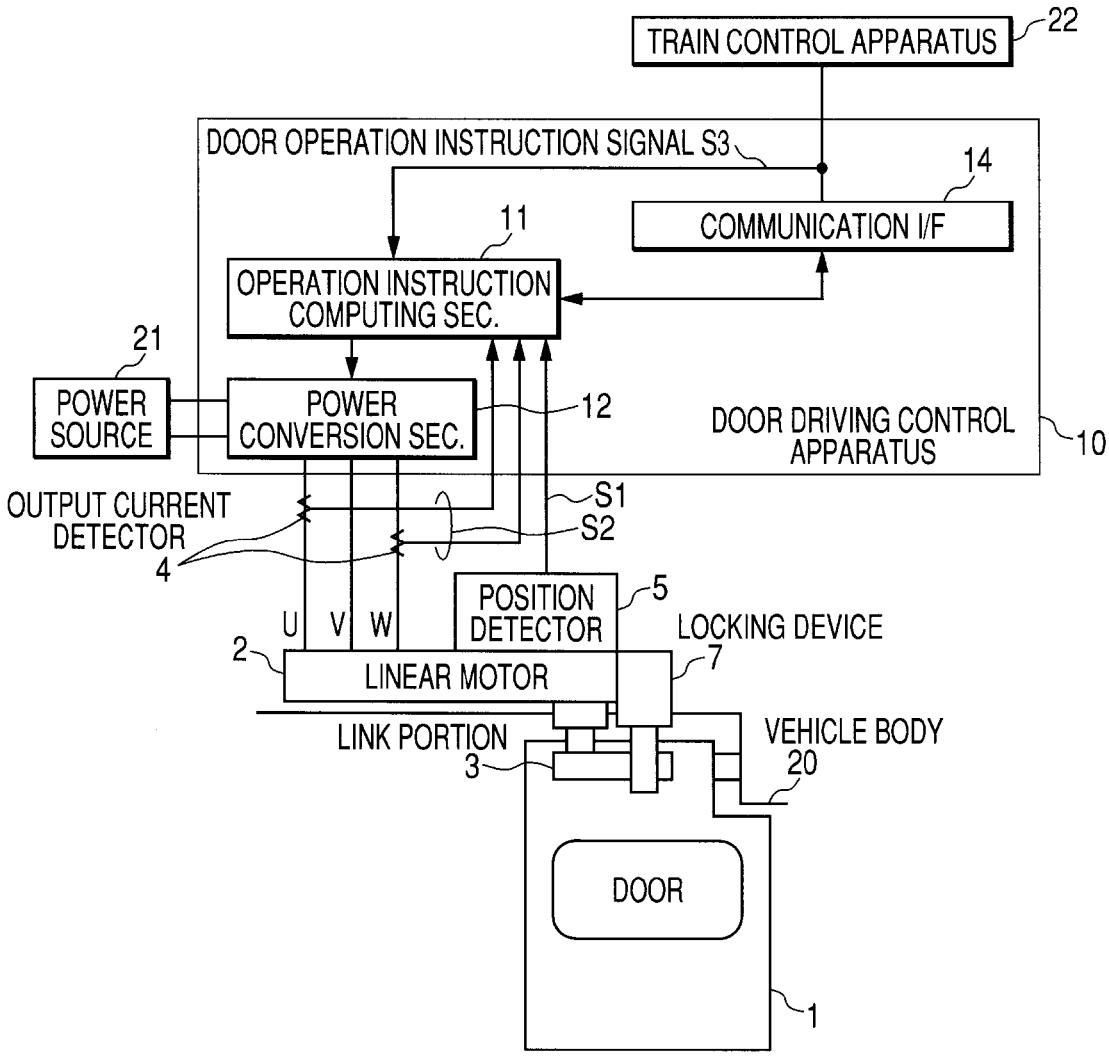
FIG. 6 shows the configuration of a conventional door driving control apparatus for a railway vehicle.
Figure 7:
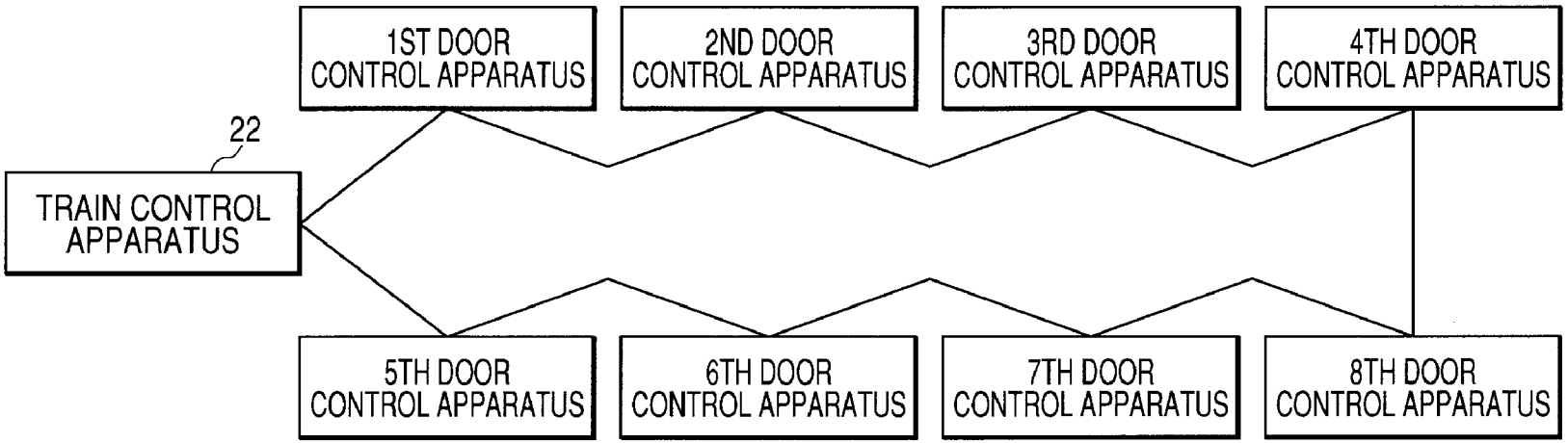
FIG. 7 shows how plural conventional door driving control apparatus for a railway vehicle are connected to a train control apparatus via communication lines.

The door driving control apparatus 40 of FIG. 1A is equipped with an operation instruction computing section 41, a power conversion section 12, and a communication interface 14, and is different from the conventional door driving control apparatus 10 of FIG. 6 in that, as shown in FIG. 1B, the operation instruction computing section 41 is equipped with a timer section 43, a comparison/judgment section 44, a flag setting section 45 for setting and resetting a door large output permission flag 45*a*, and a door opening/closure instructing section 46.

The timer section 43 starts a timer operation upon reception of a door operation instruction signal S3 from the train control apparatus 22. The timer section 43 is configured so as to be cleared if it expires in a state that the door large output permission flag 45*a* is set.

Figure 8:
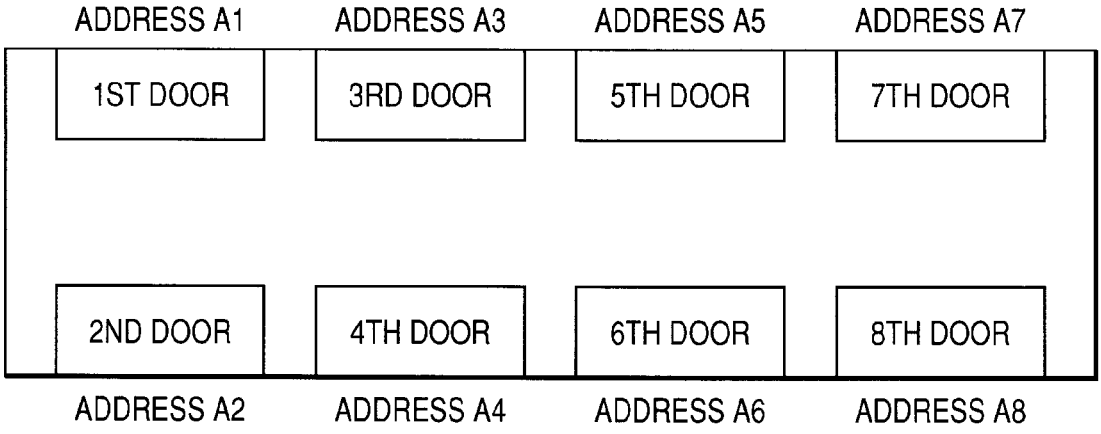
FIG. 8 shows an exemplary manner of assignment of addresses to respective doors that are controlled by the door driving control apparatus.
Figure 9:
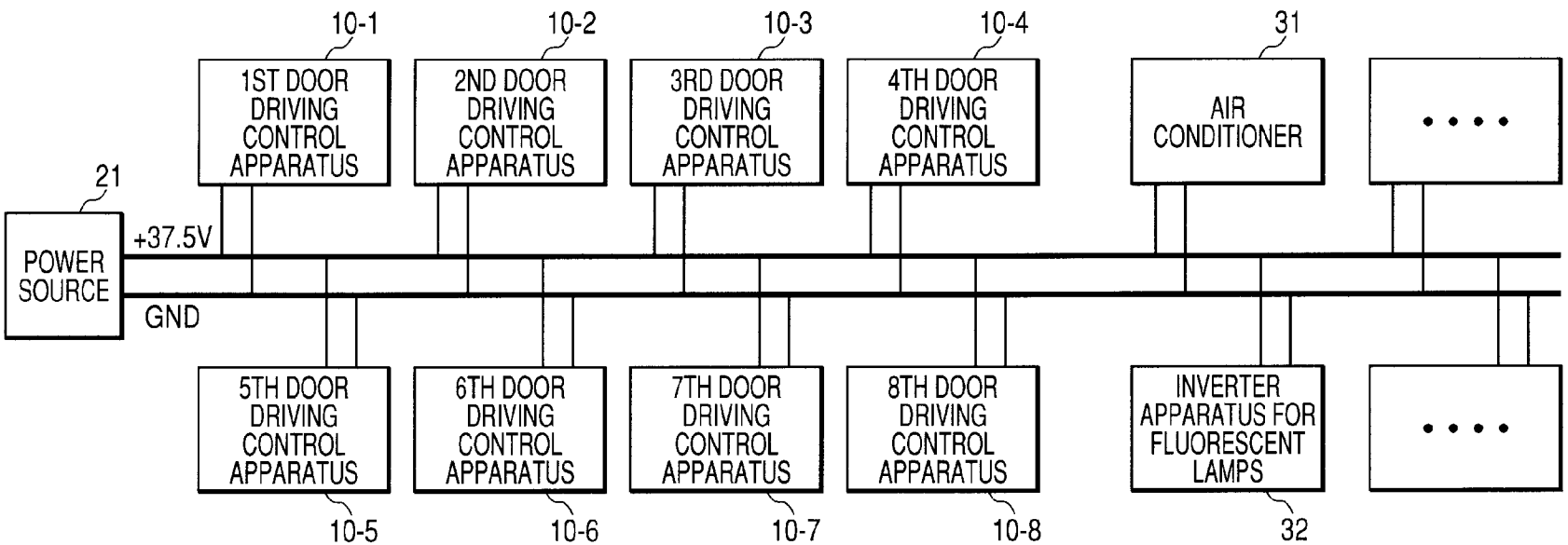
FIG. 9 shows an exemplary configuration of connections of door driving control apparatus, a power source, and other apparatus of the same car.

An offset value, which is output from the train control apparatus 22 in accordance with a door installation position recognized by a corresponding one of the addresses A1-A8 (see FIG. 8), is set in the timer section 43. The offset value is output when there is no door operation instruction signal S3. The offset values serve to deviate output timings of high torque for doors of one car from each other and thereby prevent the doors from causing a heavy load collectively when they are closed. That is, the doors are closed with timings that are deviated from each other in order on a door-by-door basis or a door group basis.

The comparison/judgment section 44 compares a timer measurement time S5 of the timer section 43 with a preset door large output setting time S6 and judges whether or not the timer measurement time S5 is longer than or equal to the preset door large output setting time S6.

If the comparison/judgment section 44 judges that the timer measurement time S5 is not longer than or equal to the preset door large output setting time S6, the flag setting section 45 keeps a state that the door large output permission flag 45*a* is reset. If the comparison/judgment section 44 judges that the timer measurement time S5 is longer than or equal to the preset door large output setting time S6, the flag setting section 45 sets the door large output permission flag 45*a*.

Figures 2A, 2B, 2C, 2D, 2E, 2F:
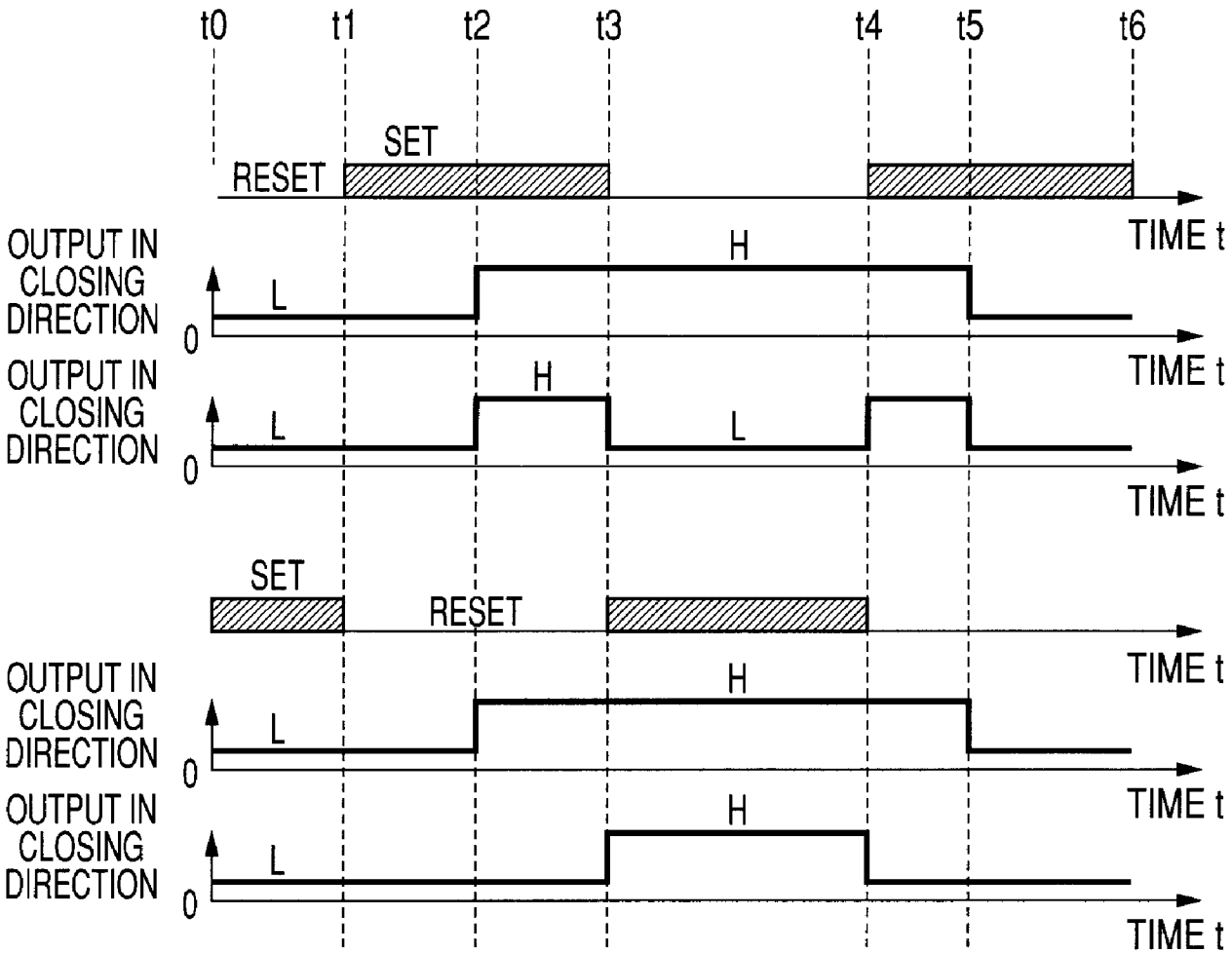
FIGS. 2A to 2F are a timing chart illustrating opening/closing driving for plural doors of the door driving control apparatus according to the first embodiment.

As shown in FIG. 2A, the door large output permission flag 45*a* is set at time t1. When the timer section 43 expires at time t3, the timer section 43 is cleared. As a result, the timer measurement time S5 becomes shorter than the door large output setting time S6 and hence the door large output permission flag 45*a* is reset immediately at time t3.

At this time, if the input of the door operation instruction signal S3 is continuing, the timer section 43 again starts a timer operation. If it is judged again at time t4 that the timer measurement time S5 is longer than or equal to the door large output setting time S6, the door large output permission flag 45*a* is set and kept set until the timer section 43 expires at time t6.

That is, the door large output permission flag 45*a* is kept in a reset state during a time width (called "reset time width") from the start of a timer operation of the timer section 43 to the end of the door large output setting time S6, and is rendered in a set state during a time width (called "set time width") from a time point when the timer measurement time S5 becomes greater than or equal to the door large output setting time S6 (i.e., the above-mentioned end of the door large output setting time S6) to a time point when the timer section 43 expires Therefore, the set time width and the reset time width appear repeatedly and alternately. Each of the set time width and the reset time width can be varied by changing the door large output setting time S6.

The door opening/closing instructing section 46 outputs a door output instruction value S7 for opening or closing the door 1 to the power conversion section 12 in response to a door operation instructing signal S3 as an opening/closure instruction. Furthermore, the door opening/closure instructing section 46 outputs a door output instruction value S7 for driving the door 1 with high torque to the power conversion section 12 if the door drive speed which can be recognized on the basis of a door position detection value S1 becomes lower than a prescribed value in a state that the door large output permission flag 45*a* is set.

Figure 3:
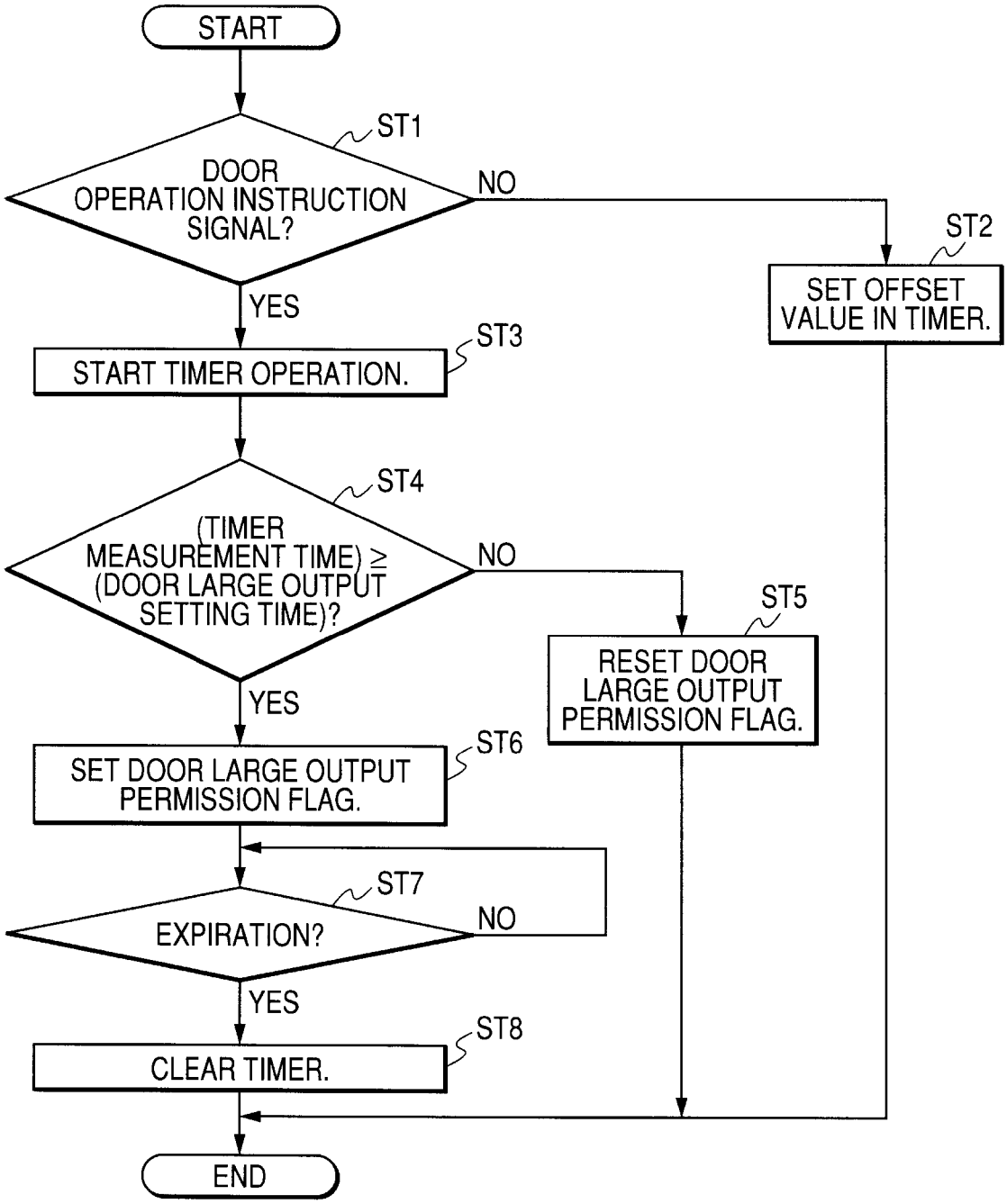
FIG. 3 is a flowchart of a process where a door large output permission flag is set by an operation instruction computing section of the door driving control apparatus according to the first embodiment.

A process that the door large output permission flag 45*a* is set by the above-configured operation instruction computing section 41 will be described with reference to a flowchart of FIG. 3.

First, if it is judged at step ST1 that no door operation instruction signal S3 is input to the operation instruction computing section 41, at step ST2 offset values which are output from the train control apparatus 22 in accordance with the installation positions of the respective doors 1 are set in the timer sections 43 for the respective doors 1.

On the other hand, if a door operation instruction signal S3 is input, the timer section 43 starts a timer operation at step ST3.

After the timer operation was started, the comparison/judgment section 44 judges at step ST4 whether or not a timer measurement time S5 is longer than or equal to the door large output setting time S6. If it is judged that the timer measurement time S5 is not longer than or equal to the door large output setting time S6, at step ST5 the flag setting section 45 keeps the door large output permission flag 45*a* in a reset state.

On the other hand, if it is judged that the timer measurement time S5 is greater than or equal to the door large output setting time S6, at step ST6 the flag setting section 45 sets the door large output permission flag 45*a*. If the timer section 43 expires at step ST7, the timer section 43 is cleared at step ST8.

Next, an operation that the door 1 is opened or closed after the door large output permission flag 45*a* was set in the above-described manner will be described with reference to the timing chart of FIGS. 2A to 2F.

FIGS. 2A to 2F relate to only the first and second doors. More specifically, FIGS. 2A and 2D show how the door large output permission flags 45*a* for those doors are set so as not to overlap with each other in time. FIGS. 2C and 2F show how high torque is output while the door large output permission flags 45*a* are set as shown in FIGS. 2A and 2D. For comparison with the control according to this embodiment, FIGS. 2B and 2E show how high torque is output in a conventional control.

It is assumed that, as shown in FIGS. 2A and 2D, the door large output permission flag for the first door (first door large output permission flag) 45*a* is set during a set time width from time t1 to t3 and a set time width from time t4 to t6 and the door large output permission flag for the second door (second door large output permission flag) 45*a* is set during a set time width from time t0 to t1 and a set time width from time t3 to t4.

It is assumed that at time t0 a door operation instruction value S3 which is a door closure instruction is input from the train control apparatus 22 to the door opening/closure instructing sections 46, whereby the first and second doors are subjected to closing operations of ordinary torque (indicated by level "L").

Also assume that both doors collide with certain foreign objects at time t2 during the closing operations and the foreign objects are removed and ordinary operations are restored at time t5. In the conventional control, as shown in FIGS. 2B and 2E, both doors are subjected to closing operations with high torque (indicated by level "H") while the foreign objects are kept pinched (from time t2 to t5). Therefore, in the conventional control, high-torque states of the plural doors overlap with each other in time. A high power is consumed and the power supply voltage of the car concerned thereby decreases during the overlap period.

In contrast, in the embodiment as shown in FIG. 2C, the first door is subjected to a closing operation of high torque only while the door large output permission flag 45*a* is set (i.e., from time t2 to t3 and from time t4 to t5). And, as shown in FIG. 2F, the second door is subjected to a closing operation of high torque only during a period from time t3 to t4 that does not overlap with the high-torque closing operation periods for the first door. In this manner, the high-torque states of the plural doors do not overlap with each other in time.

As described above, according to the door driving control of the door driving control apparatus 40 according to the first embodiment, when high torque is necessary for plural doors, those doors can be opening/closure-driven with high torque in such a manner that the periods of driving of those doors do not overlap with each other even in the case where information as to whether high torque is being output cannot be communicated between the door driving control apparatus 40. Therefore, the power supply voltage does not decrease and each door can be operated with high torque.

As a result, unlike in the conventional case, an event can be avoided where the output torque is restricted due to reduction in power supply voltage and doors cannot be operated properly (they are not locked) In other words, the doors can be locked reliably.

Second Embodiment

Figure 4:
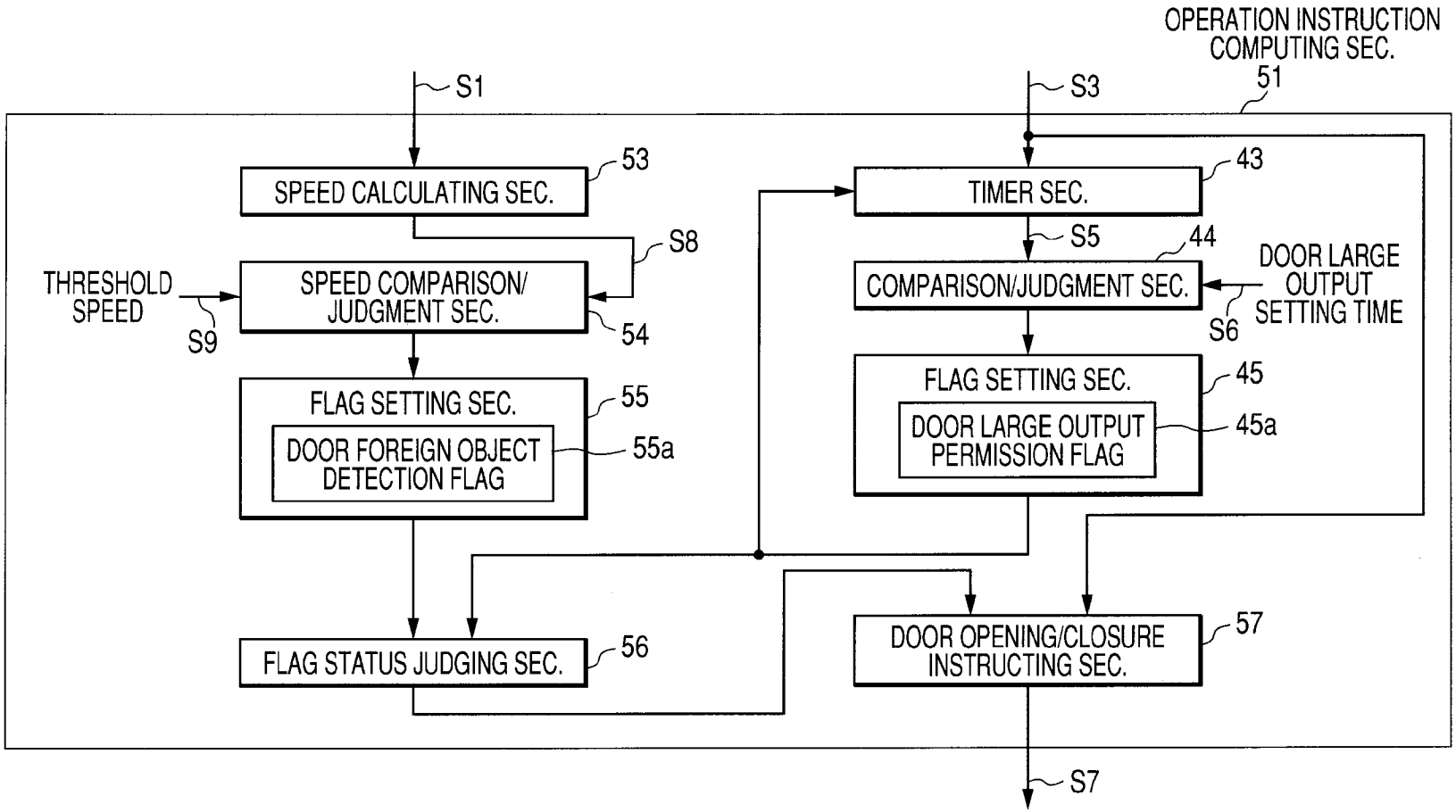
FIG. 4 is a block diagram showing the configuration of an operation instruction computing section of a door driving control apparatus for a railway vehicle according to a second embodiment of the invention.

FIG. 4 is a block diagram showing the configuration of an operation instruction computing section of a door driving control apparatus for a railway vehicle according to a second embodiment of the invention.

The operation instruction computing section instructing means 51 of FIG. 4 is equipped with, in addition to the components 43-46 of the operation instruction computing section 41 of FIG. 1B, a speed calculating section 53, a speed comparison/judgment section 54, a flag setting section 55 for setting and resetting a door foreign object detection flag 55*a*, and a flag status judging section 56. However, in FIG. 4, the door opening/closing instructing section of the second embodiment is denoted by reference numeral 57 because as described later its processing is different from the processing of the door opening/closure instructing section 46 shown in FIG. 1.

The speed calculating section 53 calculates a door speed S8 on the basis of a door position detection value S1.

The speed comparison/judgment section 54 compares the calculated door speed S8 with a preset threshold speed S9, judges whether the calculated door speed S8 is less than or equal to the threshold speed S9, and outputs a judgment result.

If the speed comparison/judgment section 54 judges that the door speed S8 is less than or equal to the threshold speed S9, the flag setting section 55 sets the door foreign object detection flag 55*a*.

The flag status judging section 56 judges the set/reset statuses of the door large output permission flag 45*a* and the door foreign object detection flag 55*a*.

The door opening/closing instructing section 57 outputs a door output instruction value S7 for closing the door 1 with high torque only if the flag status judging section 56 judges that both of the door large output permission flag 45*a* and the door foreign object detection flag 55*a* are set. If a transition occurs from a state of both flags 45*a* and 55*a* being set to a state of the door large output permission flag 45*a* being reset, the door opening/closing instructing section 57 outputs a door output instruction value S7 for causing a re-opening and closing operation in which the door 1 will be opened for a prescribed time and then subjected to an ordinary closing operation (output torque: not high torque) If a transition occurs from a state of both flags 45*a* and 55*a* being set to a state of the door foreign object detection flag 55*a* being reset, the door opening/closure instructing section 57 outputs a door output instruction value S7 for subjecting the door 1 to an ordinary closing operation.

A re-opening and closing operation which is caused by the above-configured operation instruction computing section 51 when foreign objects are pinched by doors will now be described with reference to a timing chart of FIGS. 5A to 5H.

Figures 5A, 5B, 5C, 5D, 5E, 5F, 5G, 5H:
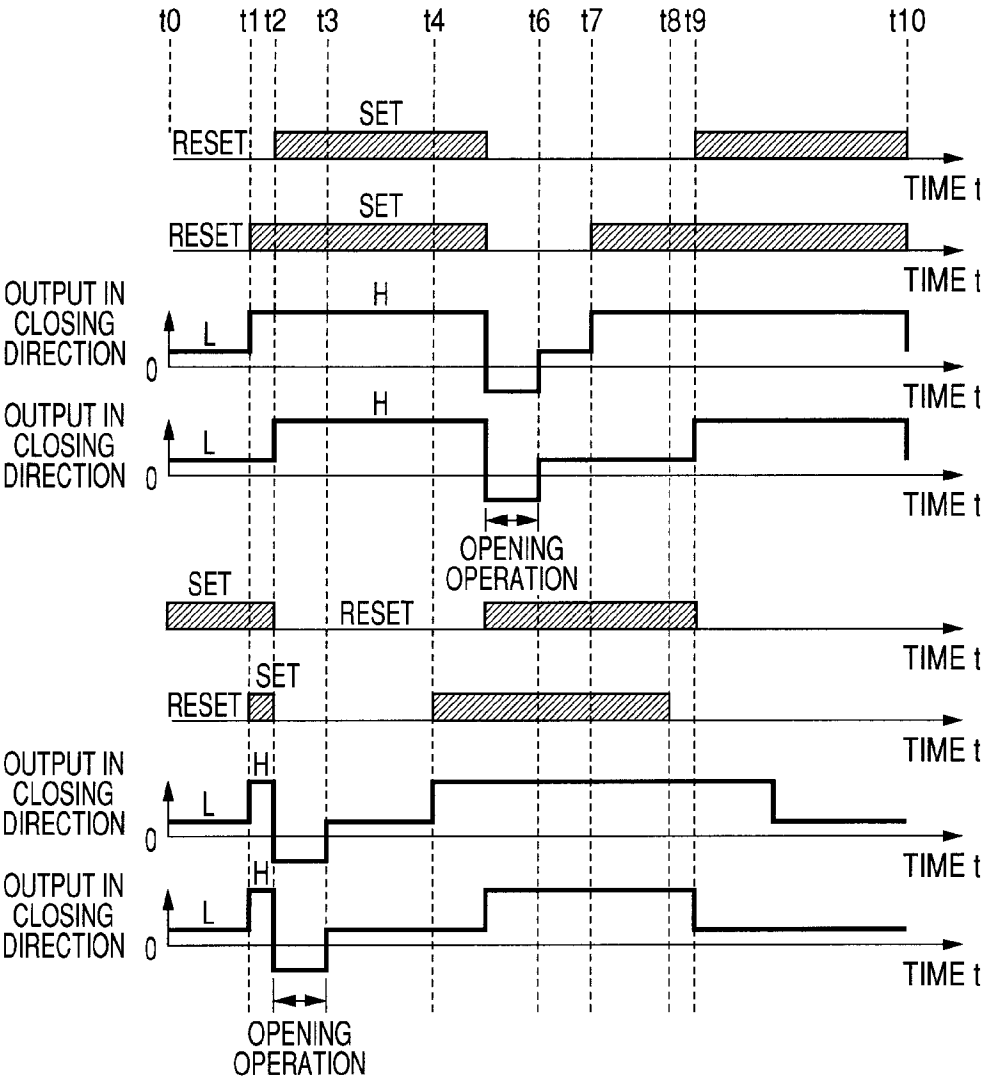
FIGS. 5A to 5H are a timing chart illustrating opening/closing driving for plural doors of the door driving control apparatus according to the second embodiment.

FIGS. 5A to 5H relate to only the first and second doors. More specifically, FIGS. 5A and 5E show how the door large output permission flags 45*a* for those doors are set so as not to overlap with each other in time. FIGS. 5B and 5F show how the door foreign object detection flags 55*a* are set. FIGS. 5D and 5H show how high torque is output while the flags 45*a* and the flags 55*a* are set as shown in FIGS. 5A and 5E and FIGS. 5B and 5F. For comparison with the control according to this embodiment, FIGS. 5C and 5G show how high torque is output in a conventional control.

It is assumed that at time t0 a door operation instruction value S3 which is a door closure instruction is input from the train control apparatus 22 to the door opening/closure instructing sections 46, whereby the first and second doors are subjected to closing operations of ordinary output torque (indicated by level "L").

Operations to be performed after time t0 will now be described starting from an operation relating to the first door. If the first door collides with a certain foreign object during the closing operation, the door speed decreases. If the speed comparison/judgment section 54 judges at time t1 that the door speed S8 has become less than or equal to the threshold speed S9, the flag setting section 55 sets the first door foreign object detection flag 55*a* as shown in FIG. 5B.

Then, when the first door large output permission flag 45*a* is set at time t2 as shown in FIG. 5A, the flag status judging section 56 judges that both of the first door large output permission flag 45*a* and the first door foreign object detection flag 55*a* are set. Receiving this judgment result, the door opening/closing instructing section 57 outputs to the power conversion section 12 a door output instruction value S7 for closing the first door with high torque. The first door is closed with high torque (indicated by level "H" in FIG. 5D), which is a foreign object pressing operation.

When the flag status judging section 56 judges at time t5 that the first door large output permission flag 45*a* has made a transition to a reset state (see FIG. 5A), the door opening/closing instructing section 57 outputs a door output instructing value S7 for subjecting the first door to a re-opening and closing operation. As a result, as shown in FIG. 5D, the first door is subjected to a re-opening and closing operation including an opening operation from time t5 to t6. The door speed increases during the opening operation. When the speed comparison/judgment section 54 finds the speed increase, the flag setting section 55 resets the first door foreign object detection flag 55*a* at time t5 as shown in FIG.

Then, the first door collides with the foreign object again and the door speed decreases. If the speed comparison/judgment section 54 judges at time t7 that the door speed S8 has become lower than or equal to the threshold speed S9, the flag setting section 55 sets the first door foreign object detection flag 55*a* as shown in FIG. 5B. While the first door large output permission flag 45*a* is kept set from time t9 to t10 as shown in FIG. 5A, the first door is subjected to a closing operation of high torque in response to a door output instruction value S7 for closing the first door with high torque (see FIG. 5D).

Next, an operation relating to the second door will be described. As already described above in the first embodiment, for the second door, as shown in FIG. 5E, the second door large output permission flag 45*a* is set in the reset periods of the first door large output permission flag 45*a* (see FIG. 5A) to avoid overlaps.

If the second door collides with a certain foreign object during the closing operation which is performed after time t0, the door speed decreases. If the speed comparison/judgment section 54 judges at time t1 that the door speed S8 has become lower than or equal to the threshold speed S9, the flag setting section 55 sets the second door foreign object detection flag 55*a* as shown in FIG. 5F.

At this time, the flag status judging section 56 judges that both of the second door large output permission flag 45*a* and the second door foreign object detection flag 55*a* are set. Receiving this judgment result, the door opening/closing instructing section 57 outputs a door output instruction value S7 for closing the second door with high torque. The second door is closed with high torque (indicated by level "H" in FIG. 5H), which is a foreign object pressing operation.

When the flag status judging section 56 judges at time t2 (i.e., soon after time t1) that the second door large output permission flag 45*a* has made a transition to a reset state (see FIG. 5E), the door opening/closure instructing section 57 outputs a door output instructing value S7 for subjecting the second door to a re-opening and closing operation. As a result, as shown in FIG. 5H, the second door is subjected to a re-opening and closing operation including an opening operation from time t2 to t3. The door speed increases during the opening operation When the speed comparison/judgment section 54 finds the speed increase, the flag setting section 55 resets the second door foreign object detection flag 55*a* at time t2 as shown in FIG. 5F.

Then, the second door collides with the foreign object again and the door speed decreases. If the speed comparison/judgment section 54 judges at time t4 that the door speed S8 has become lower than or equal to the threshold speed S9, the flag setting section 55 sets the second door foreign object detection flag 55*a* as shown in FIG. 5F. Assume that the second door large output permission flag 45*a* is kept set from time t5 to t9 as shown in FIG. 5E and the foreign object is removed and the second door foreign object detection flag 55*a* is reset at time t8 as shown in FIG. 5F.

In this case, the second door is subjected to a closing operation of high torque from the period from time t5 to t8 when the flags 45*a* and 55*a* are set (see FIG. 5H). At time t8, only the second door foreign object detection flag 55*a* makes a transition to a reset state and hence the door opening/closure instructing section 57 outputs a door output instruction value S7 for subjecting the second door to an ordinary closing operation (see FIG. 5H) The second door is thereby subjected to an ordinary closing operation.

As described above, according to the door driving control of the door driving control apparatus 40 according to the second embodiment, high-torque states of the first and second doors are prevented from overlapping with each other in time. Furthermore, when the door large output permission flag 45*a* is reset while the door is subjected to a closing operation of high torque, the closing operation is finished and a re-opening and closing operation is started immediately. When foreign objects are pinched by plural doors, this measure makes it possible to close the plural doors with high torque without decrease in power supply voltage and to remove the foreign objects more properly. If a foreign object is removed during a closing operation of high torque, an ordinary closing operation is performed. This dispenses with an unnecessary re-opening and closing operation and hence prevents useless power consumption.

In the conventional case, as shown in FIGS. 5C and 5G, a high-torque closing operation is performed while the door foreign object detection flag 55*a* is set. Therefore, high-torque states of plural doors overlap with each other in time. A high power is consumed and the power supply voltage of the car concerned thereby decreases during the overlap periods.

It should, of course, be appreciated that the invention may be practiced otherwise than as specifically disclosed herein without departing from the scope thereof.

What is claimed is:

1. A method for controlling driving of plural groups of at least one door, each said group driven by at least one respective motor, comprising the steps of:

setting a door drive torque to either a first torque or a second torque that is higher than said first torque;

setting first torque application periods for application of said first torque to said groups;

setting second torque application periods for application of said second torque to said groups;

issuing an instruction to drive each said group with said first torque only during its respective said first torque application period; and issuing an instruction to drive each said group with said second torque only during its respective said second torque application period, wherein each respective said second torque application period does not overlap in time with any other second torque application period for any other group of doors.

2. The method according to claim 1, further comprising the step of performing a door re-opening and closing operation at an end of at least one said second torque application period.

3. The method according to claim 1, further comprising the step of setting said door drive torque to said first torque if a door drive speed exceeds a predetermined speed in said second torque application period.

* * * * *